US006511332B2

(12) United States Patent
Ishikawa

(10) Patent No.: US 6,511,332 B2
(45) Date of Patent: Jan. 28, 2003

(54) LOCK ARM BOARD-CONNECTING CONNECTOR

(75) Inventor: Tatsuya Ishikawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/748,113

(22) Filed: Dec. 27, 2000

(65) Prior Publication Data

US 2001/0018280 A1 Aug. 30, 2001

(30) Foreign Application Priority Data

Dec. 27, 1999 (JP) ..... 11-370972

(51) Int. Cl.[7] ..... H01R 12/00
(52) U.S. Cl. ..... 439/79; 439/59
(58) Field of Search ..... 439/79, 59, 62, 439/357, 358

(56) References Cited

U.S. PATENT DOCUMENTS 4,717,218 A * 1/1988 Ratcliff ..... 439/59
5,755,586 A * 5/1988 Knighton et al. ..... 439/59
4,826,447 A * 5/1989 Forker et al. ..... 439/328
5,316,489 A * 5/1994 Kachlic et al. ..... 439/79
5,692,912 A * 12/1997 Nelson et al. ..... 439/79

* cited by examiner

*Primary Examiner*—P. Austin Bradley
*Assistant Examiner*—Briggitte Hammond
(74) *Attorney, Agent, or Firm*—Morgan, Lewis & Bockius LLP

(57) ABSTRACT

A board-connecting connector (100) includes a connector housing (20) having a pair of side walls (25) formed on opposite sides thereof. A plurality of lock arms (22; 24) are formed on the side walls (25) of the connector housing (20). At least one terminal receiving chamber (26), into which a terminal (30) is insertable, is formed in the connector housing (20). A spacer member engageable with the connector housing has a plurality of engagement portions (14; 16) which are respectively engaged with the lock arms (22; 24). A plurality of slits (28; 29) are formed in the side walls (25) so as to partially separate the lock arms (22; 24) from the side walls (25). With this construction, each of the lock arms (22; 24) can be elastically bent or deformed independently of separate portions (25*a*) of the side walls (25).

9 Claims, 6 Drawing Sheets

LOCK ARM BOARD-CONNECTING CONNECTOR

BACKGROUND OF THE INVENTION

1. Field of the Invention

The present invention relates to a board-connecting connector adapted to be connected directly to a board, having a circuit formed thereon, so as to connect this board to another board.

The present application is based on Japanese Patent Application No. Hei. 11-370972, which is incorporated herein by reference.

2. Description of the Related Art

A board-connecting connector is adapted to connect two boards with each other, and this connector comprises a spacer member for being fixed to the board, a connector housing engaged with this spacer member, and electrically-conductive terminals received in the connector housing. One example of such board-connecting connector is shown in FIGS. 8A and 8B.

As shown in FIG. 8A, this board-connecting connector 200 comprises a connector housing 60, terminals 70 received in the connector housing 60, and a spacer member 80.

A strip-like projection 82 is formed on the spacer member 80, and engagement projections 84 are formed on opposite end portions of this strip-like projection 82, respectively, and also an engagement projection 86 is formed on a central portion of the strip-like projection 82. Similarly, two engagement projections 84 and an engagement projection 86 are also formed on a reverse side (lower side in the drawings) of the strip-like projection 82.

As shown in FIG. 8B, elastic lock arms 62 for being engaged respectively with the engagement projections 84 are formed at opposite end portions of the connector housing 60, and lock portions 64 for being engaged respectively with the engagement projections 86 are formed on a central portion of the connector housing 60.

The lock arms 60 and the lock portions 64 are formed integrally with opposed side walls 65 of the connector housing 60.

As shown in FIG. 9 which is a side-elevational view, when the connector housing 60 is fitted on the spacer member 80, the side walls 65 are pressed by the engagement projections 84 and 86, and are elastically bent or deformed outwardly over the entire length thereof. Therefore, when attaching the connector housing 60, an insertion force, large enough to elastically deform the side walls 65, is required, so that a connector-attaching force and a connector-disconnecting force increase.

And besides, the lock arms 62 and the lock portions 64 are formed integrally with the side walls 65 of the connector housing 60, and therefore deformation, such as a sink and a warp, can develop on the relatively-thin side walls 65 during the formation of the connector housing 60. As a result, the lock arms 62 and the lock portions 64 are deformed as a result of deformation of the side walls 65 as shown in FIG. 10, and this has invited a problem that the connector-connecting operation can not be carried out properly.

SUMMARY OF THE INVENTION

With the above problems in view, it is an object of the present invention to provide a board-connecting connector in which the deformation of lock arms are prevented during a molding operation, and an insertion force, required for a connector-connecting operation, is reduced.

To achieve the above object, according to the first aspect of the present invention, there is provided a connector which comprises a connector housing having a pair of side walls formed on opposite sides thereof; a plurality of lock arms formed on the side walls of the connector housing; at least one terminal receiving chamber, into which a terminal is insertable, formed in the connector housing; and a spacer member engageable with the connector housing, the spacer member having a plurality of engagement portions which are respectively engageable with the lock arms of the connector housing, wherein a plurality of slits are formed in the side walls so as to partially separate the lock arms from the side walls.

In this connector, when the engagement portions are respectively engaged with the lock arms, the whole of each side wall of the connector housing is not elastically deformed, but only the lock arms are elastically deformed to engage the engagement portions, respectively. Therefore, the inserting force can be reduced. And besides, even when the lock arms and the engagement portions have slight dimensional errors, such dimensional errors will not cause a strain, such as a warp, to develop on the other portion of the connector housing, and therefore the shape precision can be maintained.

According to the second aspect of the present invention, it is preferable that the lock arms are respectively formed on opposite end portions of the side walls, and the engagement portions are respectively formed on opposite end portions of the spacer member. In this connector, at least two of the slits may be formed in each of the side walls so that a separate portion of each of the side walls is located between the lock arms. With this construction, the connector housing and the spacer member can be connected together in a stable manner.

According to the third aspect of the present invention, it is preferable that the lock arms are further formed respectively on central portions of the side walls, and the engagement portions are further formed respectively on central portions of the spacer member. In this connector, at least two of the slits may be formed in each of the side walls so that each of the lock arms is located between separate portions of each of the side walls. With this construction, the connecting stability of the connector is enhanced, and the connector housing and the spacer member can be connected together more positively.

Further, the slits may open toward the spacer member engaged with the connector housing.

Furthermore, the lock arms may be opposed to each other. In this case, when the spacer member is engaged with the connector housing, the lock arms can sandwich the engagement portions.

DETAILED DESCRIPTION OF THE PREFERRED EMBODIMENT

A preferred embodiment of a board-connecting connector of the present invention will now be described in detail with reference to the drawings.

Figure 1:
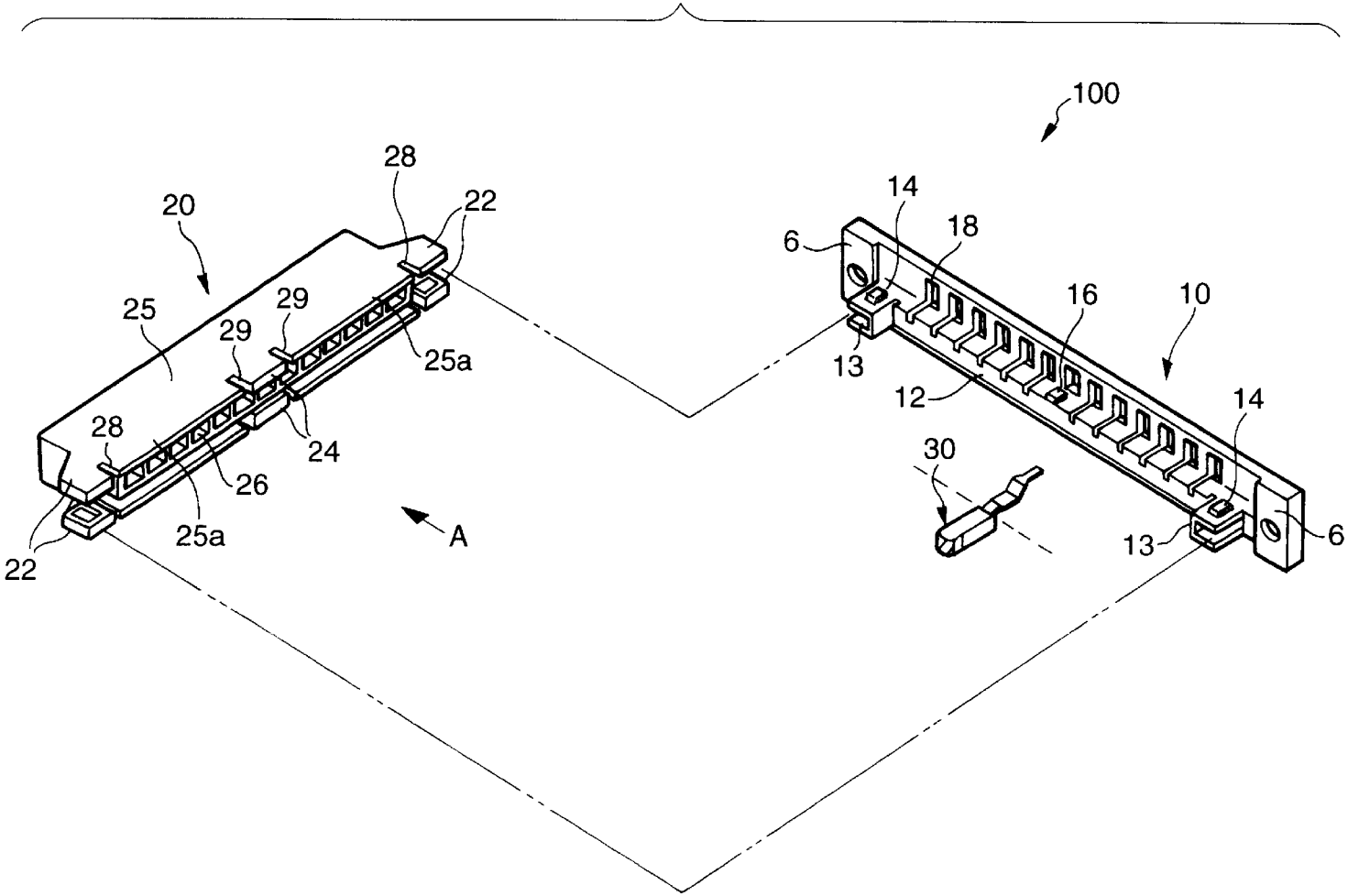
FIG. 1 is an exploded, perspective view of a board-connecting connector of the present invention.
Figure 5:
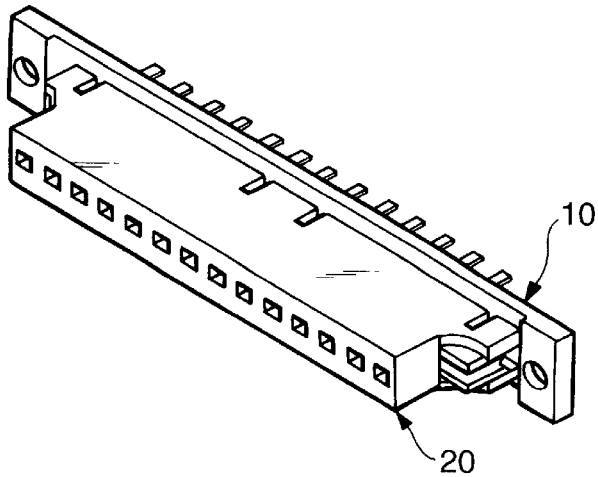
FIG. 5 is a perspective view showing a condition in which the spacer member and the connector housing are engaged with each other.

FIG. 1 is an exploded, perspective view of the board-connecting connector of this embodiment, and FIG. 5 is a perspective view of the board-connecting connector in its assembled condition.

As shown in FIG. 1, the board-connecting connector 100 of this embodiment is adapted to be fixed directly to a board, having a circuit formed thereon, so as to connect this board to another board. This connector 100 comprises a spacer member 10 for being fixedly mounted to the board (not shown), a connector housing 20 attached to this spacer member 10, and a plurality of terminals 30 received in the connector housing 20.

A strip-like projection 12 is formed on that side of the spacer member 10 to be connected to the connector housing 10, and extends in a direction of a length of the spacer member 10. Retaining piece portions 13 are formed at opposite end portions of the strip-like projection 12, respectively. Engagement projections 14 are formed on the retaining piece portions 13, respectively, and also an engagement projection 16 is formed on a central portion of the strip-like projection 12. Similarly, two engagement projections 14 and 14 and an engagement projection 16 are also formed on a reverse side (lower side in the drawings) of the strip-like projection 12. Therefore, the six engagement projections in all are formed on the obverse and reverse sides of the strip-like projection 12.

Fixing portions 6 are formed integrally at the opposite ends of the spacer member 10, and the spacer member 10 is fixedly secured to the board by screws or the like passing respectively through these fixing portions 6. Openings or ports 18 are formed through that portion of the spacer member 10 disposed adjacent to a proximal portion of the strip-like projection 12, and one end portions of the terminals 30 are passed through these openings 18, respectively.

Elastic lock arms 22 and 22 for being engaged respectively with the corresponding engagement projections 14 and 14 are formed respectively at opposite end portions of each of opposed side walls 25 of the connector housing 20, and an elastic lock arm 24 for engagement with the engagement projection 16 is formed on a central portion of the side wall 25.

The lock arms 22, 22 and 24 are formed integrally with the side wall 25 of the connector housing 20. However, slits 28 are formed in the side wall 25, and are disposed immediately adjacent respectively to one sides of the lock arms 22 and 22 close to terminal receiving chambers 26, and slits 29 are formed in the side wall 25, and are disposed immediately adjacent to opposite sides of the lock arm 24, respectively. With this construction, each of the lock arms 22, 22 and 24 can be elastically bent or deformed independently of the side wall 25.

Figure 2:
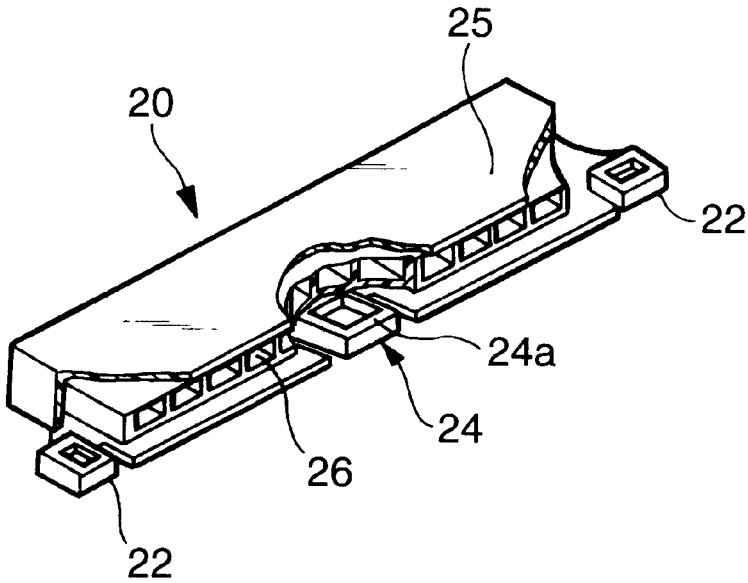
FIG. 2 is a perspective view of the board-connecting connector in its assembled condition.

As shown in FIG. 2 which is a partially-broken view of the connector housing 20, each of the lock arms 22, 22 and 24 has a step portion 24*a* formed on and projecting from the inner surface of each of the opposed side walls 25 of the connector housing 20.

Figure 3:
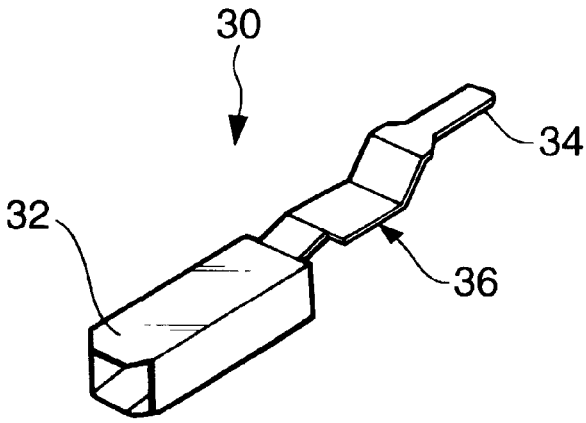
FIG. 3 is a perspective view showing the construction of a terminal.

As shown in FIG. 3, a contact portion 32 for connection to a mating terminal is formed at one end of the terminal 30, and a soldering fixing portion 34 is formed at the other end of the terminal 30, and this soldering fixing portion 34 is passed through the opening 18 in the spacer member 10, and is fixedly secured to the board (not shown) by soldering. A bent portion 36, bent into a crank-like configuration, extends between the contact portion 32 and the soldering fixing portion 34, and this bent portion 36 can absorb a stress developing during the insertion of the terminal 30.

The terminals 30 are inserted respectively into the terminal receiving chambers 26 formed in the connector housing 20, and the soldering fixing portions 34 of the terminals 30, fixedly received in the connector housing 20, are passed respectively through the openings 18 in the spacer member 10.

Next, an operation for connecting the connector housing 20, having the lock arms 22 and the 24, to the spacer member 10, having the engagement projections 14 and 16, will be described.

Figure 4A:
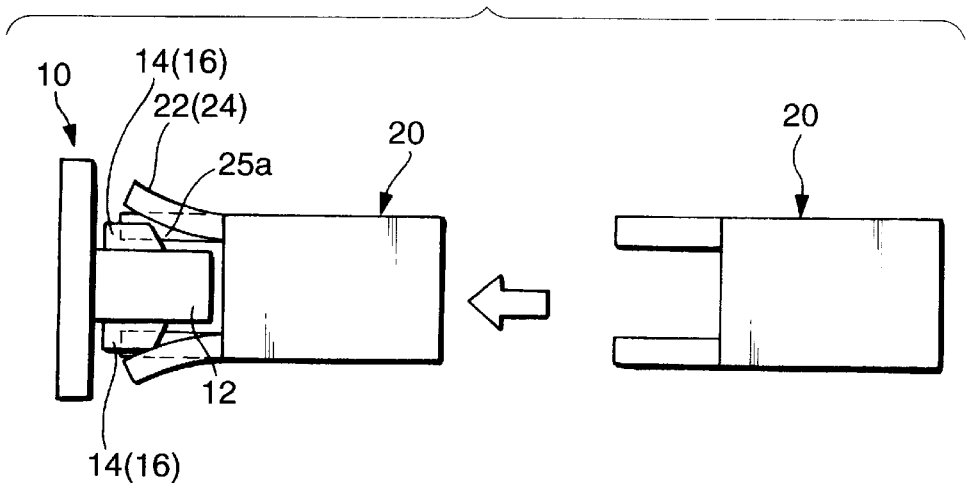
FIGS. 4A and 4B are side-elevational views showing the manner of fitting a connector housing on a spacer member so as to connect the two together.
Figure 4B:
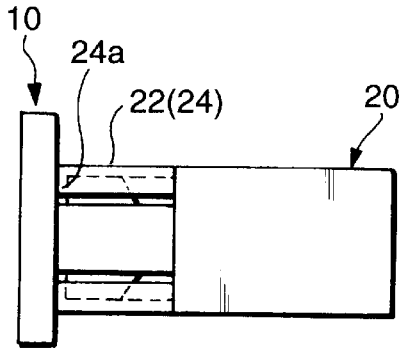

FIGS. 4A and 4B are side-elevational views showing the manner of fitting the connector housing 20 on the spacer member 10 to connect the connector housing 20 to the spacer member 10. When the connector housing 20 is fitted on the spacer member 10 as shown in FIG. 4A, only those portions of each side wall 25, defining the lock arms 22, 22 and 24, respectively, are pressed respectively by the engagement projections 14, 14 and 16, and are deformed outwardly. On the other hand, the remaining portion 25*a* of the side wall 25 other than the lock arms 22, 22 and 24 does not contact the engagement projections 14, 14 and 16, and is not influenced by the deformation of the lock arms 22, 22 and 24, and therefore is kept in a straight or flat condition.

Then, when the step portion 24*a* of each of the lock arms 22, 22 and 24 fits on the associated engagement projection 14, 14, 16, each lock arm 22, 22, 24 is restored into its original condition (that is, a straight condition), and finally the connector housing 20 is engaged with the spacer member 10.

Figure 6:
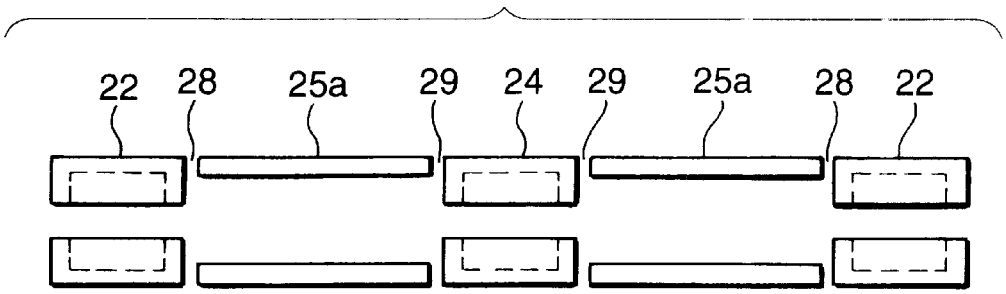
FIG. 6 is a view as seen in a direction of arrow A of FIG. 1.
Figure 7:
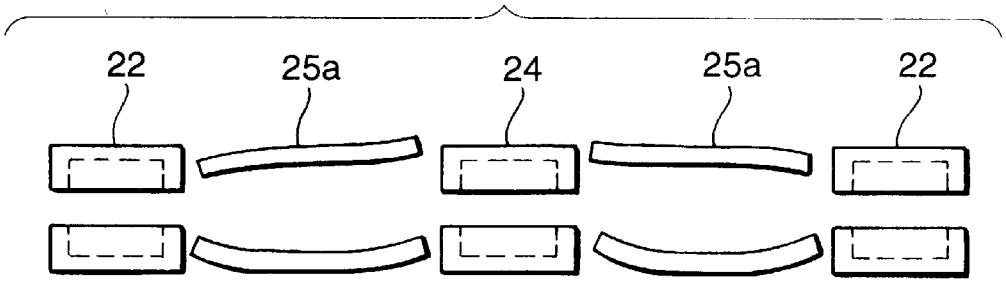
FIG. 7 is a view as seen in the direction of arrow A of FIG. 1, showing the deformation of side walls.
Figure 8A:
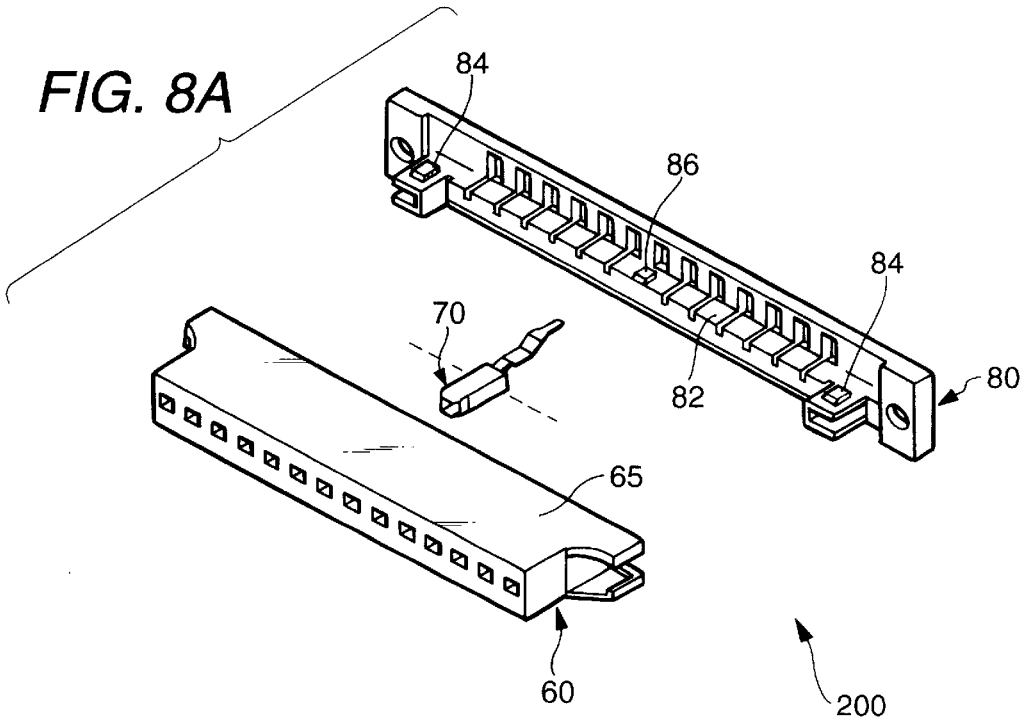
FIGS. 8A and 8B are views showing the construction of a related board-connecting connector.
Figure 8B:
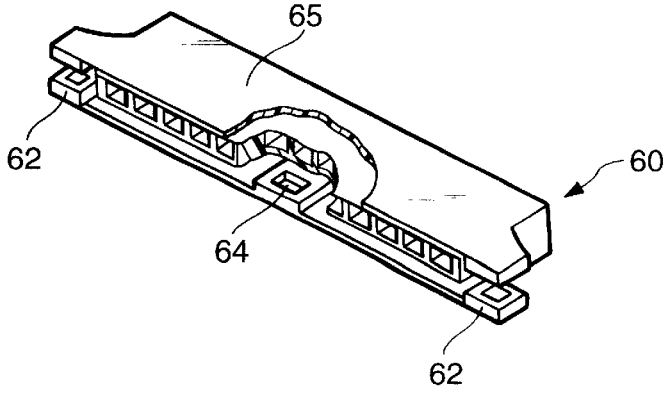
Figure 9:
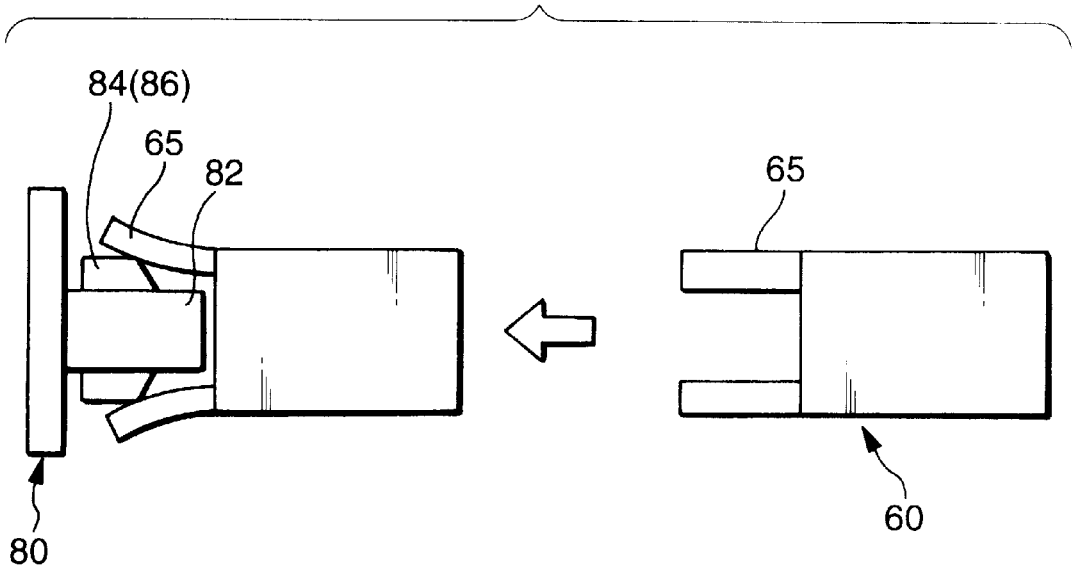
FIG. 9 is a side-elevational view showing the manner of fitting a connector housing on a spacer member in the related board-connecting connector.
Figure 10:
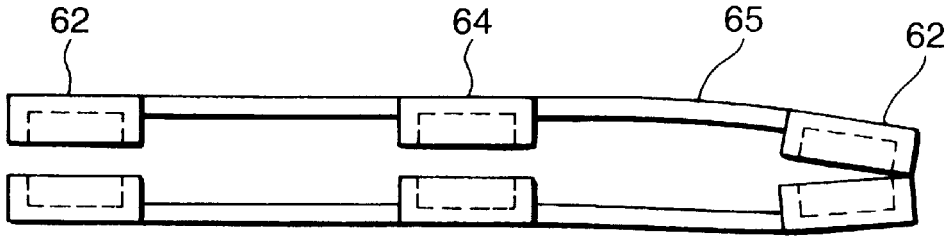
FIG. 10 is a view showing a condition in which deformation, such as a warp and a sink, develops on side walls.

FIG. 5 is a perspective view showing the spacer member 10 and the connector housing 20 thus engaged with each other. As shown in FIG. 6 which is a view as seen in a direction of arrow A of FIG. 1, the opposite side edges of each lock arm 22 are separated from the side wall 25 by the slits 28 while the opposite side edge of the lock arm 24 are separated from the side wall 25 by the slits 29. Therefore, even when a warp or a sink develops on the relatively-thin side walls 25 of the connector housing 20 during the molding of the connector housing 20, so that the side wall portions 25*a* are deformed as shown in FIG. 7, the lock arms 22, 22 and 24 on each side wall 25 are not influenced by the deformation of the side wall portion 25*a*, and therefore are kept flat.

Each side wall portion 25*a* is partially separated from the relatively-thick lock arms 22, 22 and 24 as described above, and therefore the deformation of the side wall portions 25*a* is reduced during the molding operation, and therefore the side wall portions 25*a* will not adversely affect the engagement of the connector housing 20 with the spacer member 10.

Thus, the adverse effects, caused by the deformation of the thin portions (liable to be deformed during the molding operation) and the thickness-varying portions, are greatly reduced, the engagement portions of the connector housing 20 for engagement with the spacer member 10 are prevented from deformation. As a result, the force for engaging the connector housing 20 with the spacer member 10, as well as the force for disengaging the connector housing 20 from the spacer member 10, can be kept to a low level.

The lock arms are formed respectively at the opposite end portions of each of the side walls 25 of the connector housing 20, and with this construction the connection between the connector housing 20 and the spacer member 10 can be stabilized. The lock arm is further formed at the central portion of each side wall of the connector housing, and with this construction the connector housing and the spacer member can be more positively held in the connected condition.

In the board-connecting connector of the present invention, deformation, such as a warp and a sink, developing around each of the lock arms during the molding operation, is prevented, and besides the force for inserting and withdrawing the spacer member against the resilient force of the lock arms can be reduced.

What is claimed is:

1. A connector, comprising:

a connector housing having a pair of side walls formed on opposite sides thereof, a plurality of lock arms formed on the side walls of the connector housing;

at least one terminal receiving chamber, into which a terminal is insertable, formed in the connector housing; and a spacer member engageable with the connector housing, the spacer member having a plurality of engagement portions which are respectively engageable with the lock arms of the connector housing, wherein a plurality of slits are formed in the side walls so as to partially separate the lock arms from the side walls.

2. The connector of claim 1, wherein the slits open toward the spacer member engaged with the connector housing.

3. The connector of claim 1, wherein the lock arms are opposed to each other, and wherein when the spacer member is engaged with the connector housing, the lock arms sandwich the engagement portions.

4. The connector of claim 1, wherein the lock arms are respectively formed on opposite end portions of the side walls, and the engagement portions are respectively formed on opposite end portions of the spacer member.

5. The connector of claim 2, wherein the lock arms are further formed respectively on central portions of the side walls, and the engagement portions are further formed respectively on central portions of the spacer member.

6. The connector of claim 5, wherein at least two of the slits are formed in each of the side walls so that each of the lock arms is located between separate portions of each of the side walls.

7. A connector, comprising:

a connector housing having a pair of side walls formed on opposite sides thereof;

a plurality of lock arms formed on the side walls of the connector housing;

at least one terminal receiving chamber, into which a terminal is insertable, formed in the connector housing; and a spacer member engageable with the connector housing, the spacer member having a plurality of engagement portions which are respectively engageable with the lock arms of the connector housing, wherein a plurality of slits are formed in the side walls so as to partially separate the lock arms from the side walls;

wherein the lock arms are respectively formed on opposite end portions of the side walls, and the engagement portions are respectively formed on opposite end portions of the spacer member;

wherein at least two of the slits are formed in each of the side walls so that a separate portion of each of the side walls is located between the lock arms.

8. A connector, comprising:

a connector housing having a pair of side walls formed on opposite sides thereof;

a plurality of lock arms formed on the side walls of the connector housing;

at least one terminal receiving chamber, into which a terminal is insertable, formed in the connector housing; and a spacer member engageable with the connector housing, the spacer member having a plurality of engagement portions which are respectively engageable with the lock arms of the connector housing, wherein a plurality of slits are formed in the side walls so as to partially separate the lock arms from the side walls;

wherein the lock arms are respectively formed on central portions of the side walls, and the engagement portions are respectively formed on central portions of the spacer member.

9. The connector of claim 4, wherein at least two of the slits are formed in each of the side walls so that each of the lock arms is located between separate portions of each of the side walls.

* * * * *